United States Patent [19]

Raymond

[11] Patent Number: 4,565,070

[45] Date of Patent: Jan. 21, 1986

[54] APPARATUS AND METHOD FOR DEFROSTING A HEAT EXCHANGER IN A REFRIGERATION CIRCUIT

[75] Inventor: Glendon A. Raymond, Fulton, N.Y.

[73] Assignee: Carrier Corporation, Syracuse, N.Y.

[21] Appl. No.: 499,958

[22] Filed: Jun. 1, 1983

[51] Int. Cl.[4] ..... F25B 41/00

[52] U.S. Cl. ..... 62/81; 62/278; 62/198

[58] Field of Search ..... 62/80, 81, 278, 155, 62/324.1, 196 R, 196 B, 197, 198, 199

[56] References Cited

U.S. PATENT DOCUMENTS 2,998,710 9/1961 Reese .

OTHER PUBLICATIONS

Bonhotal, Larry, Defrost How Hot Gas Does It, Mar. 1979, pp. 33 and 34.

*Primary Examiner*—Henry Bennett

*Attorney, Agent, or Firm*—Robert H. Kelly

[57] ABSTRACT

An apparatus and method for providing a refrigeration circuit and for effecting defrost are disclosed. Multiple outdoor heat exchangers are utilized to effect defrost of one of the outdoor heat exchangers while the other serves as an evaporator. In the refrigeration circuit disclosed, the indoor heat exchanger is not utilized during defrost and the outdoor heat exchangers are separated such that one is defrosted while the other serves as an evaporator. The circuit may then be reversed such that the non-defrosted outdoor heat exchanger is then defrosted while the other heat exchanger serves as an evaporator. This refrigeration circuit allows for effective defrost of the outdoor heat exchangers without necessitating electric resistance heat nor the transfer of heat energy from the indoor air to the outdoor heat exchangers.

13 Claims, 4 Drawing Figures

DEFROST CYCLE FOR COIL I

HEATING CYCLE

COOLING CYCLE

DEFROST CYCLE FOR COIL I

DEFROST CYCLE FOR COIL 2

APPARATUS AND METHOD FOR DEFROSTING A HEAT EXCHANGER IN A REFRIGERATION CIRCUIT

BACKGROUND OF THE INVENTION

1. Field of the Invention

This invention relates in general to refrigeration circuits and more particularly to apparatus and a method to effect defrost of outdoor heat exchangers incorporated in air conditioning apparatus such as a heat pump.

2. Prior Art

A conventional refrigeration circuit employs a compressor, condenser, expansion means and evaporator connected to form a refrigerant flow circuit. The compressor raises the pressure and temperature of gaseous refrigerant and the gaseous refrigerant is then conducted to the condenser where it gives off heat energy to a cooling fluid and is condensed to a liquid. This liquid refrigerant then flows through an expansion means such that its pressure is reduced and is therefore capable of changing from a liquid to a gas absorbing heat energy during this phase change. Complete change of state from a liquid to a gas occurs in the evaporator and the heat energy is removed from the media flowing in heat transfer relation with the evaporator. Gaseous refrigerant from the evaporator is then conducted back to the compressor.

Under appropriate ambient conditions, the media flowing in heat transfer relation with the evaporator, typically air, has its temperature lowered below its dew point. Once the temperature of the air is below the dew point, moisture is deposited on the coil surfaces resulting in a collection of fluid thereon. If the ambient temperature conditions are sufficiently low or if the temperature of the evaporator is sufficiently low this liquid on the heat exchange surface changes state to ice. Once this ice or frost coats the surfaces of the heat exchanger, the efficiency of the heat exchanger is impaired and overall system efficiency decreases. Consequently, it is desirable to maintain the evaporator surfaces free from ice or frost.

Formation of ice or frost on the heat exchanger surface is particularly acute with heat pumps used to provide heating to an enclosure. In the operation of the heat pump in the heating mode, the outdoor coil functions as an evaporator such that heat energy may be absorbed from the outside air. If the outside air is at a low temperature the evaporator must operate at an even lower temperature and consequently may operate under the appropriate environmental conditions such that ice and frost are formed thereon.

Many systems have been developed for defrosting heat exchanger surfaces. These include supplying heat from another heat source to the coil surface to melt the ice and reversing the refrigeration system such that hot gas discharged from the compressor is circulated through the evaporator to melt the ice thereon. The inconvenience accompanying reversing the system is that heat energy may be removed from the enclosure via the indoor coil to supply heat energy for effecting defrost. Under these conditions it is necessary to supply electrical resistance heat at the indoor heat exchanger such that air being circulated to the enclosure is not cooled as it passes through the indoor heat exchanger serving as an evaporator during defrost. By utilizing electric resistance heat, the temperature of the air is maintained such that occupants of the enclosure being conditioned are not subjected to "cold blow" when the indoor heat exchanger is serving as an evaporator.

Non-reverse defrost systems, systems which do not include a reversal in the flow path of the refrigerant through the refrigeration circuit have been previously utilized and are disclosed in the art. Most of these systems concern bypassing the condenser such that hot gas from the compressor is discharged directly into the evaporator to melt any ice formed thereon. The refrigerant is then circulated back to the compressor. Means for vaporizing any liquid refrigerant may also be included.

The present refrigeration circuit utilizes multiple outdoor heat exchangers such that the defrost of either heat exchanger may occur without removing heat energy from the enclosure via the indoor heat exchanger. During normal heating or cooling operation refrigerant is circulated through both outdoor heat exchangers in series as if they were a single heat exchanger. An interconnecting line between the two heat exchangers allows the refrigerant to pass therebetween without undergoing any pressure drop.

When it is desirable to effect defrost of the outdoor heat exchangers the refrigerant circuiting is such that the indoor heat exchanger is bypassed entirely and no heat energy is removed from the indoor air via the indoor heat exchanger. The two outdoor heat exchangers are then connected to each other through a restrictor such that hot gaseous refrigerant is supplied to one of the outdoor heat exchangers which will serve as the condenser absorbing heat energy from the refrigerant to condense the refrigerant to a liquid. This heat energy effectively melts the ice formed on the heat exchanger surfaces. The liquid refrigerant then undergoes a pressure drop in the restrictor and is supplied to the other of the two outdoor heat exchangers wherein it is vaporized absorbing heat energy from the outdoor air. This other heat exchanger is then acting as an evaporator. Gaseous refrigerant is then supplied back to the compressor.

To effect defrost of both outdoor heat exchangers they are defrosted in order. In other words, while one of said outdoor heat exchangers is being defrosted the other is serving as an evaporator. Upon completion of defrost of one of said outdoor heat exchangers the interconnecting circuiting is reversed such that the other of said outdoor heat exchangers then serves as a condenser and the heat exchanger already being defrosted serves as an evaporator. In this manner the entire outdoor heat exchange surface may be effectively defrosted.

Although referred to as two outdoor heat exchangers herein, it is highly conceivable that these multiple outdoor heat exchangers would really be different circuits or different portions of a single master heat exchanger. In other words, if a plate fin type heat exchanger is utilized in an outdoor unit of a refrigeration circuit the circuits placed on the heat exchanger may be broken such that the appropriate interconnecting piping is provided somewhere in between such that two outdoor heat exchangers are effectively provided within a single plate fin heat exchanger. A wrapped fin heat exchanger could likewise be divided somewhere such that certain circuits are considered to be one heat exchanger and certain circuits are considered to be another heat exchanger. Should a single master heat exchanger be provided, it is most likely that the largest amount of frost will accumulate on the bottom portion of the heat exchanger. In this event, it may be desirable to only operate the defrost process in a single mode such that the lower portion of the outdoor heat exchanger is defrosted. It may actually be found that it is not necessary to effect defrost of the upper portion of the outdoor heat exchanger, hence, a single defrost mode would be sufficient to achieve the desired purpose.

The first and second outdoor heat exchangers referred to herein may each have multiple circuits. Multiple connecting lines and bypass lines may then be used to connect the individual circuits of each heat exchanger to the individual circuits of the other heat exchanger.

SUMMARY OF THE INVENTION

It is an object of the present invention to provide a system for effecting defrost of a heat exchanger.

It is another object of the present invention to provide a system for effecting defrost of a heat exchanger.

It is another object of the present invention to provide a method and apparatus serving as a refrigeration circuit.

It is a still further object of the present invention to provide multiple outdoor heat exchangers in a refrigeration circuit which may be connected as a single heat exchanger or connected to serve as both a condenser and evaporator of the refrigeration circuit.

It is a further object of the present invention to provide a method and apparatus for effecting defrost of a refrigeration circuit without removing heat energy from indoor air.

It is a yet further object of the present invention to prevent an indoor coil from supplying cool air to an enclosure to be conditioned during defrost of the refrigeration circuit.

It is yet another object of the present invention to provide defrost of an outdoor heat exchanger without utilizing electric resistance heaters.

It is a still further object of the present invention to provide a method of effecting defrost of a refrigeration circuit without the utilization of a four-way valve and the accompanying noise during switching of said four-way valve.

It is a further object of the present invention to provide a safe, economical, reliable and easy to manufacture and service refrigeration circuit incorporating a non-reverse defrost system.

These and other objects of the present invention are achieved utilizing a refrigeration circuit including a compressor and an indoor heat exchanger, a first outdoor heat exchanger, a second outdoor heat exchanger and conduit means including valve means. The conduit means connects the compressor in the heating mode of operation to direct hot gaseous refrigerant to the indoor heat exchanger and to receive refrigerant from both the first and second outdoor heat exchangers when it is desirable to supply heat energy to the indoor heat exchanger. In the defrost mode of operation the conduit means connects the compressor to discharge hot gaseous refrigerant to the first or the second outdoor heat exchanger and receives gaseous refrigerant from the other of said first or second outdoor heat exchangers. Interconnecting means are provided to connect the first outdoor heat exchanger to the second outdoor heat exchanger including means to allow refrigerant to flow between the first and second outdoor heat exchangers without undergoing a significant pressure drop and restrictor means for creating a pressure drop as refrigerant flows between the first and second outdoor heat exchangers, said means allowing the refrigerant to pass without significant pressure drop when in the heating mode of operation and said means causing the refrigerant to flow through the restrictor means creating a pressure drop when in the defrost mode of operation.

A method of operating a refrigertion circuit having a compressor and an indoor heat exchanger, first outdoor heat exchanger, second outdoor heat exchanger, restrictor means, expansion means and appropriate interconnecting piping including valving is further disclosed. The method includes placing the valve means in the appropriate position such that refrigerant flows from the first to the second outdoor heat exchanger serially without undergoing a pressure drop when the system is either in the heating or cooling modes of operation and such that refrigerant flows between the first and second outdoor heat exchangers undergoing a pressure drop when it is operated in a mode to effect defrost of either the first or second outdoor heat exchangers.

An outdoor heat exchange unit for use with a refrigeration circuit is further disclosed. The outdoor heat exchanger comprises a first outdoor heat exchanger, second outdoor heat exchanger, fan means for circulating air in heat exchange relation with the heat exchangers, a refrigerant line connecting the first outdoor heat exchanger to the second outdoor heat exchanger, said line being sufficiently sized to prevent any significant pressure drop as refrigerant flows between the two heat exchangers, a refrigerant line valve mounted within the refrigerant line, said valve having an open position allowing refrigerant flow without restriction and a closed position preventing refrigerant flow, a bypass line connecting the first heat exchanger to the second heat exchanger in parallel with the refrigerant line and the refrigerant line valve and restrictor means mounted in the bypass line to effect a pressure drop in the refrigerant flowing between the first and second outdoor heat exchangers through the bypass line.

DESCRIPTION OF THE PREFERRED EMBODIMENT

The embodiment as described herein will refer to a heat pump system capable of supplying both heating and cooling to an enclosure to be conditioned. It is to be understood that this method of effecting defrost and appropriate circuiting has like applicability to refrigeration circuits where frosting may occur other than heat pump systems. For instance, a cold room where an evaporator cools air below the freezing point might experience a frost accumulation problem. A freezer or commercial refrigeration device might similarly have such frost accumulation problems which likewise necessitate defrost.

Although shown only in schematic from herein it is to be understood that the first and second outdoor heat exchangers could be a single master heat exchanger such as a plate fin or slit fin heat exchanger. In such a case, the division into first and second outdoor heat exchangers would be simply the interconnections between circuits of the heat exchangers such that a single structural heat exchanger may, in fact, be both the first and second outdoor heat exchangers.

Figure 1:
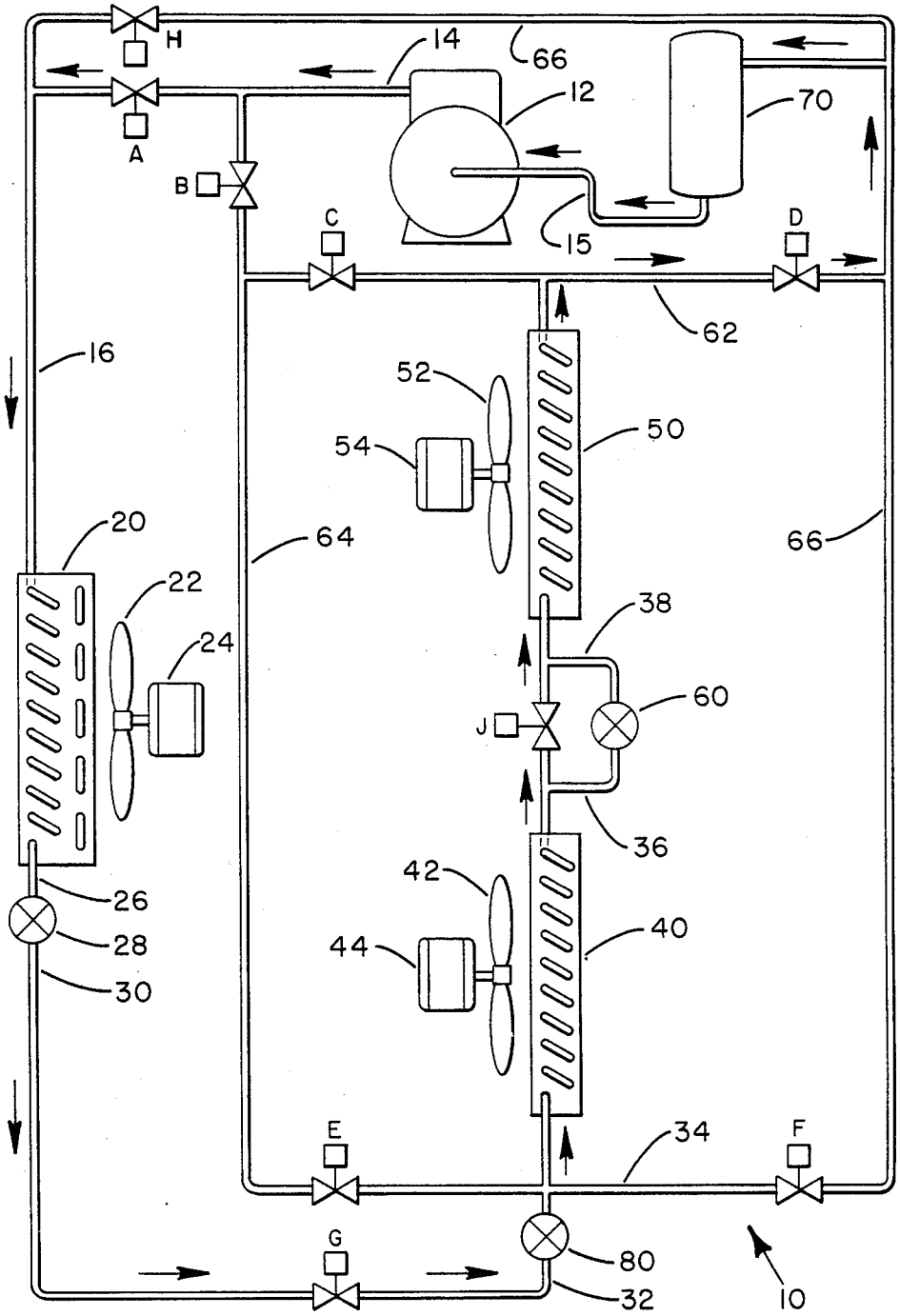
FIG. 1 is a schematic diagram of a refrigeration circuit shown in the heating mode of operation.
Figure 2:
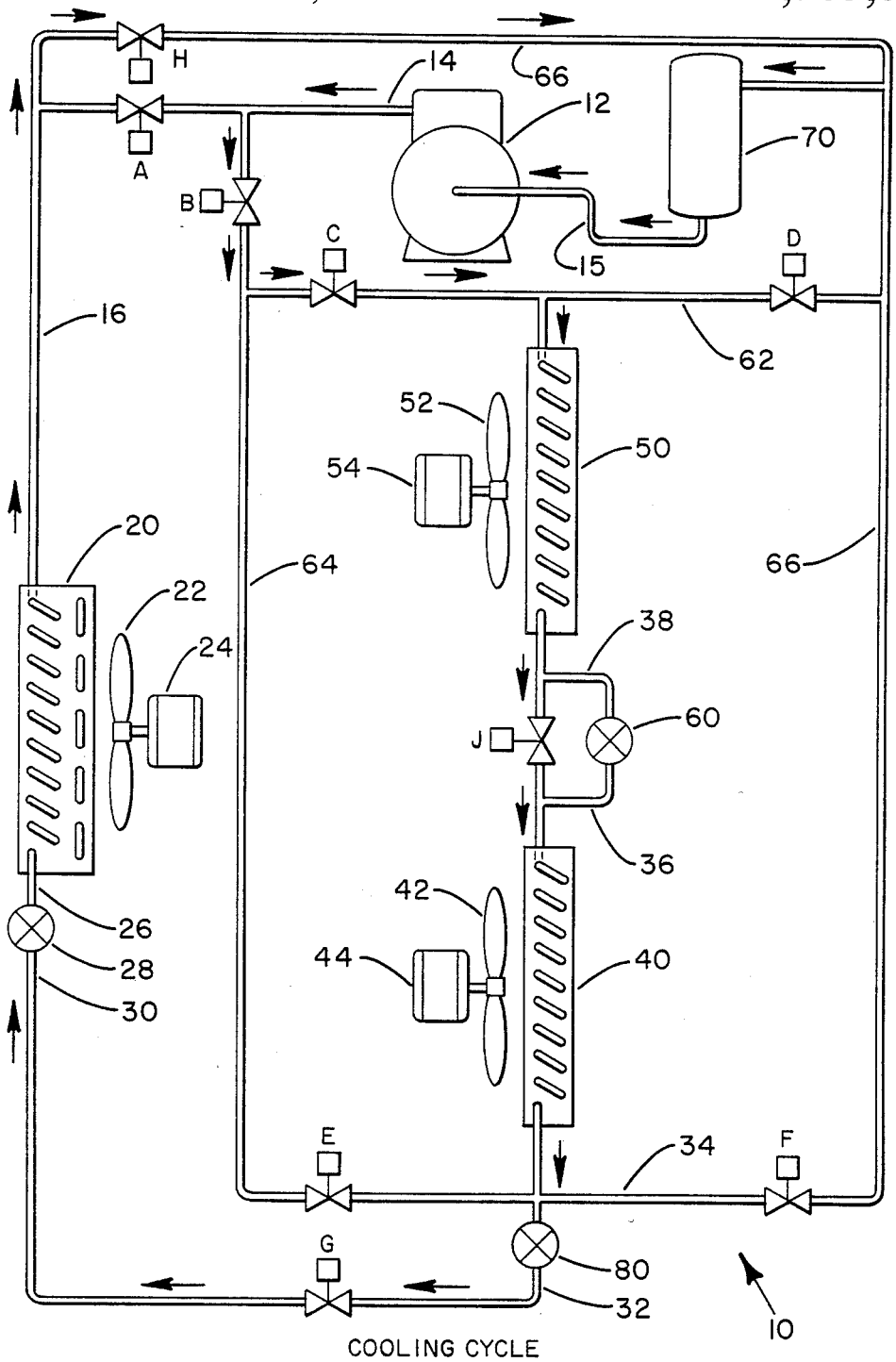
FIG. 2 is a schematic diagram of the refrigeration circuit shown in the cooling mode of operation.
Figure 3:
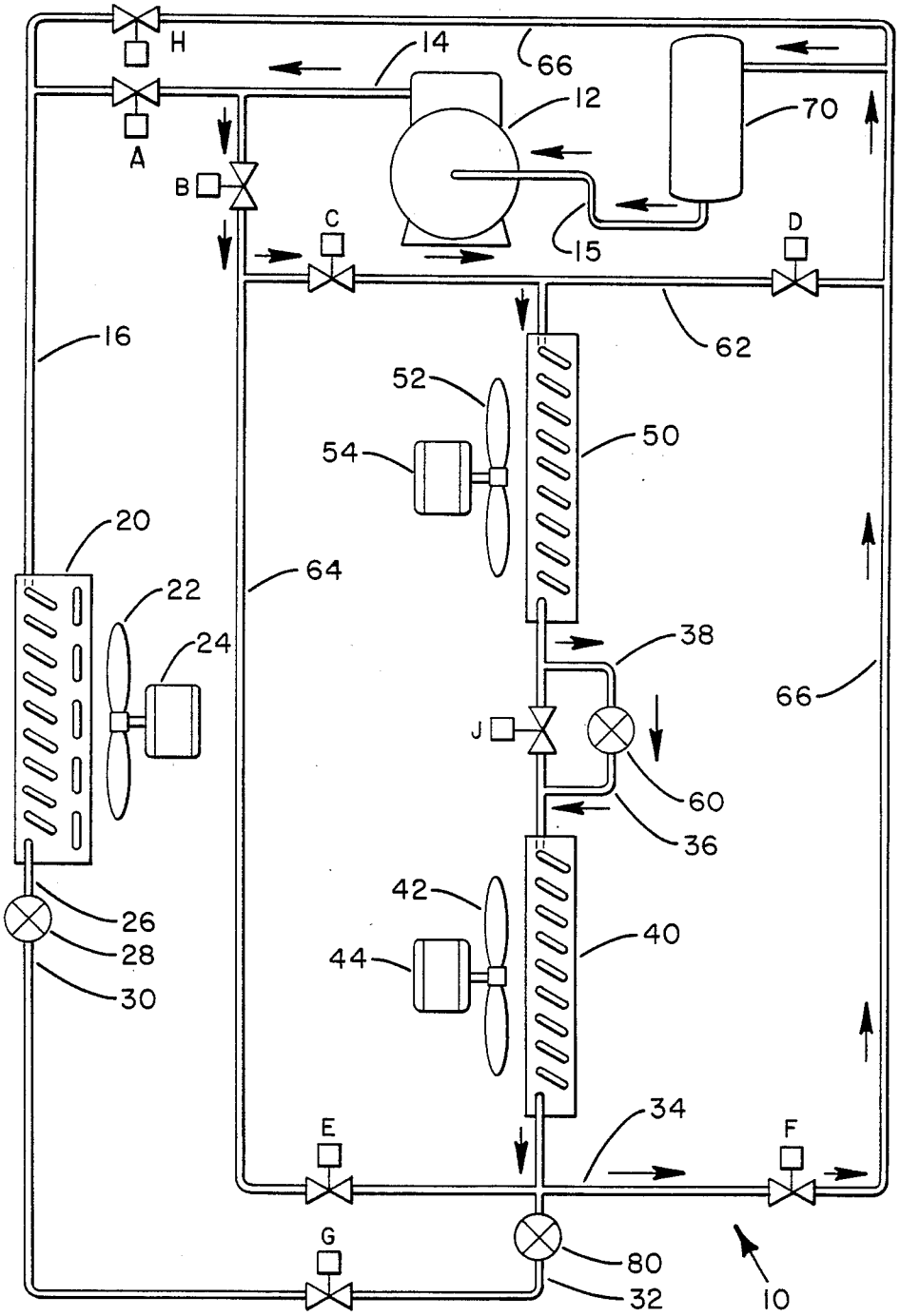
FIG. 3 is a schematic diagram of the refrigeration circuit shown in the defrost mode of operation for effecting defrost of the first outdoor heat exchanger.
Figure 4:
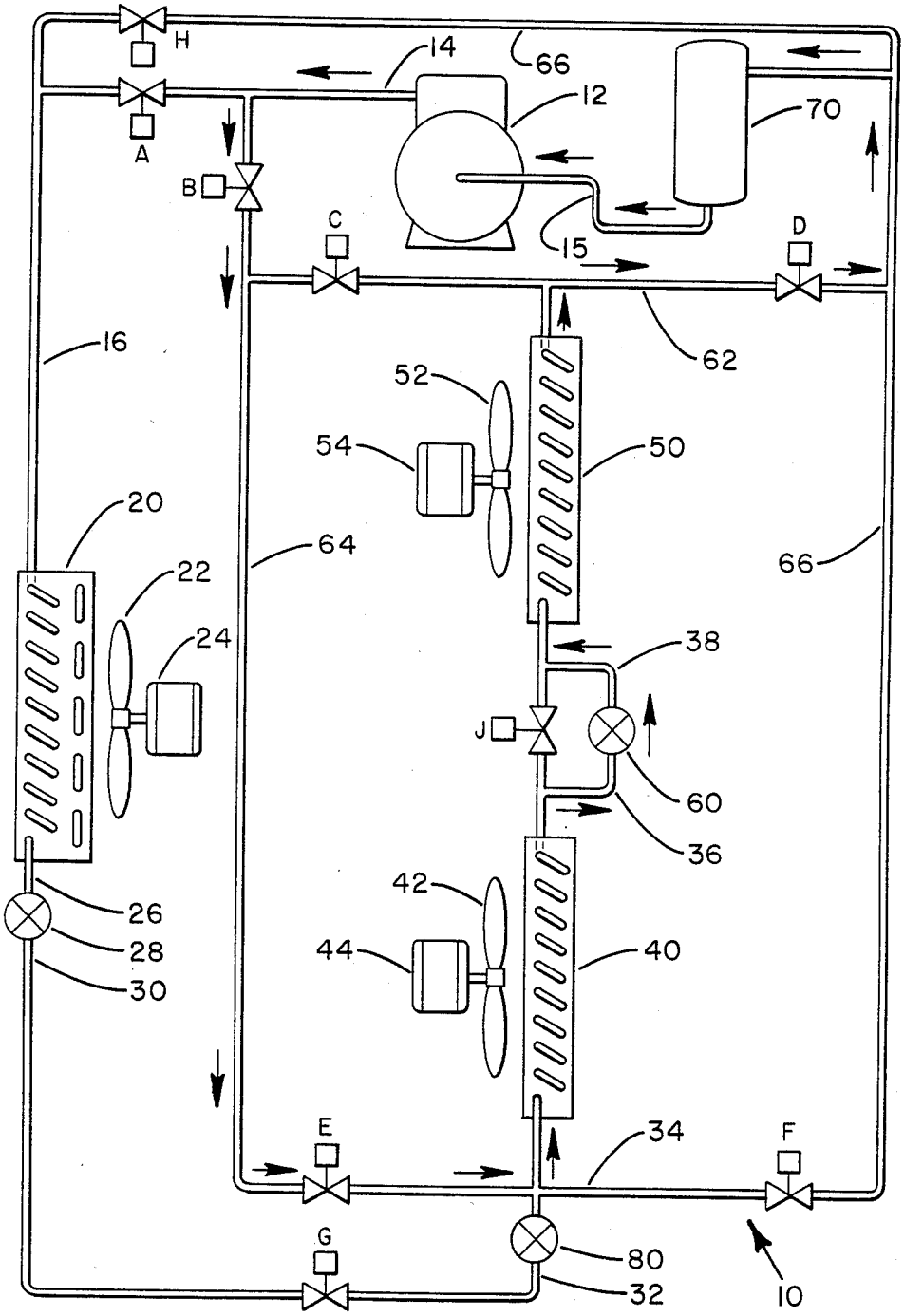
FIG. 4 is a schematic diagram of the refrigeration circuit showing the circuit in the defrost mode for effecting defrost of the second outdoor heat exchanger.

Referring now to FIG. 1, there may be seen a refrigeration circuit 10. Compressor 12 is shown connected to discharge hot gaseous refrigerant to compressor discharge line 14. Compressor discharge line 14 is connected through solenoid valve A to line 16 which is connected to indoor heat exchanger 20 and solenoid valve H. Indoor heat exchanger 20 is connected via line 26 to one-way restrictor 28 to line 30. Line 30 is connected through solenoid valve G to line 32 which is connected to expansion device 80. Expansion device 80 is connected to line 34 which is connected to solenoid valves E and F and to second outdoor heat exchanger 40. Indoor fan motor 24 is shown connected to indoor fan 22 for circulating air in heat exchange relation with indoor heat exchanger 20.

Compressor discharge line 14 is also connected to solenoid valve B which is connected to line 64 which is connected to solenoid valves C and E. Line 62 is connected to solenoid valves C and D as well as first outdoor heat exchanger 50. Line 38 connects first outdoor heat exchanger 50 to solenoid valve J and to two-way restrictor 60. Line 36 connects two-way restrictor 60 and solenoid valve J to second outdoor heat exchanger 40. Outdoor fan motor 44 is connected to outdoor fan 42 for circulating air in heat exchange relation with second outdoor heat exchanger 40. Outdoor fan motor 54 is connected to fan 52 for circulating outdoor air in heat exchange relation with the first outdoor heat exchanger 50. Solenoid valves D, F and H are all connected via line 66 to accumulator 70. Accumulator 70 is connected through compressor suction line 15 to compressor 12.

OPERATION

Heating Mode

In the heating mode of operation as shown in FIG. 1, solenoid valves A, G, J and D are open and solenoid valves H, B, C, E and F are closed. In this mode, hot gaseous refrigerant is directed from compressor 12 through compressor discharge line 14 through open solenoid valve A through line 16 to indoor heat exchanger 20. In indoor heat exchanger 20 the hot gaseous refrigerant is condensed to a liquid giving up its heat of condensation to indoor air being circulated in heat exchange relation therewith. The condensed liquid refrigerant then flows through line 26, through one-way restrictor 28 which allows the refrigerant to pass without restriction and then through line 30 and open solenoid valve G to expansion device 80. Expansion device 80 acts to create a pressure drop in the refrigerant such that liquid refrigerant flows at a reduced pressure to second outdoor heat exchanger 40 through line 34. From second outdoor heat exchanger 40 the refrigerant flows through line 36, through open solenoid valve J, through line 38 and through first outdoor heat exchanger 50. The two outdoor heat exchangers serve as an evaporator wherein liquid refrigerant changes state absorbing heat energy from the outdoor ambient air circulated in heat exchange relation therewith. Gaseous refrigerant is then discharged from the first outdoor heat exchanger through line 62, through open solenoid valve D, through line 66 to the accumulator and therefrom back to the compressor through compressor suction line 15.

Cooling Mode

In the cooling mode of operation heat energy is transferred from the indoor air in heat exchange relation with indoor heat exchanger 20 to outdoor ambient air in heat exchange relation with both the first and second outdoor heat exchangers. In the cooling mode of operation solenoid valves B, C, J, G and H are open and solenoid valves A, D, E and F are closed. Hot gaseous refrigerant from the compressor is directed through compressor discharge line 14, through open solenoid valve B, through line 64, through open solenoid valve C, through line 62 to outdoor heat exchanger 50. From outdoor heat exchanger 50 the refrigerant is directed through lines 38, open solenoid valve J, through line 36, through the second outdoor heat exchanger 40 to expansion device 80. The first and second outdoor heat exchangers serve as a condenser wherein the gaseous refrigerant is condensed to a liquid refrigerant giving up its heat of condensation to the outdoor ambient air being circulated in heat exchange relation therewith. Solenoid valve J is open such that no significant refrigerant pressure drop occurs as the refrigerant flows between the two outdoor heat exchangers.

The refrigerant then flows through line 34 through expansion device 80 and flows through line 32, through open solenoid G, through one-way restrictor 28 where it undergoes a pressure drop and then to line 26 to the indoor heat exchanger wherein the refrigerant changes state from a liquid to a gas absorbing heat energy from the indoor air being circulated in heat exchange relation therewith. Gaseous refrigerant then flows through line 16 through open solenoid valve H, through line 66, to the accumulator 70 and back to the compressor suction line 15 to be returned to the compressor.

Defrost Cycle One

In the first defrost mode of operation, heat energy is supplied to the first outdoor heat exchanger to melt the ice formed thereon. In this mode of operation, solenoid valves B, C and F are open and solenoid valves A, H, E, G, D and J are closed. Refrigerant is directed from compressor discharge line 14, through open solenoid valve B, through line 64, through open solenoid valve C, through line 62 to the first outdoor heat exchanger 50. The hot gaseous refrigerant is condensed in the first outdoor heat exchanger 50 giving up its heat of condensation to the heat exchange surface to melt the accumulated frost thereon. Typically, the fan motor 54 will be de-energized to prevent the transfer of heat energy to the ambient air under these conditions.

Since solenoid valve J is closed, the liquid refrigerant being discharged from first outdoor heat exchanger 50 is directed through line 38, through the restrictor 60, and through line 36 to the second outdoor heat exchanger 40. Restrictor 60 acts as an expansion device such that the liquid refrigerant undergoes a pressure drop prior to being directed to the second outdoor heat exchanger 40. Within second outdoor heat exchanger 40 the liquid refrigerant vaporizes absorbing its heat of vaporization from the outdoor ambient air being circulated in heat exchange relation therewith. This gaseous refrigerant is then directed through line 34, through open solenoid valve F, through line 66 to the accumulator 70 and back to the compressor through the compressor suction line 15. In this mode of operation, the first outdoor heat exchanger 50 serves as a condenser and the second outdoor heat exchanger 40 serves as an evaporator such that heat energy is transferred between the two outdoor heat exchangers to effect defrost of one of them.

Defrost Cycle Two

Defrost cycle two is similar to defrost cycle one in that one of the two outdoor heat exchangers is defrosted by circulating hot gaseous refrigerant to that heat exchanger serving as a condenser. In this mode of operation, solenoid valves B, E and D are open and solenoid valves A, H, G, F, C and J are closed. Hot gaseous refrigerant is directed from the compressor discharge line 14, through open solenoid valve B, through line 64, through open solenoid valve E to the second outdoor heat exchanger serving as a condenser. From the second outdoor heat exchanger 40 the refrigerant is directed through line 36 to restrictor 60, and through line 38 to the first outdoor heat exchanger 50 serving as an evaporator. From first outdoor heat exchanger 50 the refrigerant is directed through line 62, through open solenoid valve D, through line 66, and through accumulator 70 to the compressor suction line back to the compressor 12. This mode of operation is similar to defrost cycle one except that the second outdoor heat exchanger 40 serves as the condenser absorbing heat energy to melt the frost accumulated thereon and the first outdoor heat exchanger 50 serves as an evaporator absorbing heat energy from the outdoor ambient air to vaporize the liquid refrigerant received from the condenser.

Valve J and two-way restrictor 60 could be a single valve having an orifice sized opening extending therethrough. In this instance, when the valve is open the refrigerant flows therethrough without undergoing a pressure drop. When the valve is closed the refrigerant is metered through the valve opening serving as an expansion device.

As stated previously herein, the two outdoor heat exchangers may be part of a single master heat exchanger divided to accomplish the separate functions. Additionally, the frost accumulated on the heat exchanger may be on the heat exchanger located downwardly from the other heat exchanger since water tends to drip downwardly and the bulk of the ice accumulates at the bottom of the heat exchange surface. In particular applications, it may be found that a single defrost mode is sufficient to effectively accomplish defrost of the entire heat exchanger.

The invention has been described herein with reference to a particular embodiment. It is to be understood by those skilled in the art that variations and modifications can be effected within the spirit and scope of the invention.

What is claimed is:

1. A refrigeration circuit including a compressor and an indoor heat exchanger which comprises:

a first outdoor heat exchanger;

a second outdoor heat exchanger;

conduit means including valve means connecting the compressor in a heating mode of operation to direct hot gaseous refrigerant to the indoor heat exchanger and to receive refrigerant from both the indoor and outdoor heat exchangers when it is desirable to supply heat energy to the indoor heat exchanger and in the defrost mode of operation connecting the compressor to discharge hot gaseous refrigerant to either the first or the second outdoor heat exchangers and receiving gaseous refrigerant from the other of said first or second outdoor heat exchangers; and interconnecting means connecting the first outdoor heat exchanger to the second outdoor heat exchanger including means to allow refrigerant to flow between the first and second outdoor heat exchangers without undergoing a significant pressure drop and restrictor means for creating a pressure drop as refrigerant flows between the first and second outdoor heat exchangers, said means allowing the refrigerant to pass without significant pressure drop when in the heating mode of operation and said means causing the refrigerant to flow through the restrictor means creating a pressure drop when in the defrost mode of operation.

2. A method of operating a refrigeration circuit having a compressor, an indoor heat exchanger, a first outdoor heat exchanger, a second outdoor heat exchanger, restrictor means, expansion means and appropriate interconnecting piping including valve means which comprises the steps of:

placing the valve means in the appropriate position in the cooling mode of operation to direct refrigerant from the compressor serially through the two outdoor heat exchangers, the expansion means and the indoor heat exchanger back to the compressor;

placing the valve means in the appropriate position in the heating mode of operation to direct the refrigerant from the compressor serially through the indoor heat exchanger, the expansion means, the two outdoor heat exchangers and back to the compressor; and placing the valve means in a defrost mode of operation to direct refrigerant from the compressor serially to one of the outdoor heat exchangers, the restrictor means, the other outdoor heat exchanger and back to the compressor.

3. An outdoor heat exchange unit for use in a refrigeration circuit, the refrigeration circuit including a compressor and an indoor heat exchanger, which comprises:

a first outdoor heat exchanger;

a second outdoor heat exchanger;

fan means for circulating air in heat exchange relationship with the heat exchangers;

a conduit means including a plurality of valve means being located to allow refrigerant flow between the compressor and said first and second outdoor heat exchangers;

a refrigerant line connecting the first outdoor heat exchanger to the second outdoor heat exchanger, said line being sufficiently sized to prevent a significant pressure drop as refrigerant flows between the two heat exchangers;

a refrigerant line valve mounted in the refrigerant line, said valve having an open position allowing refrigerant flow without restriction and a closed position preventing refrigerant flow;

a bypass line connecting the first heat exchanger to the second heat exchanger in parallel with the refrigerant line and refrigerant line valve; and restriction means mounted in the bypass line to effect a pressure drop in refrigerant flowing between the first and second outdoor heat exchangers through the bypass line.

4. The apparatus as set forth in claim 1 wherein the conduit means includes means in the defrost mode of operation for directing refrigerant flow to bypass the indoor heat exchanger and flow directly to the one of the outdoor heat exchangers to be defrosted.

5. The apparatus as set forth in claim 1 wherein the interconnecting means further comprises a refrigerant line connecting the first outdoor heat exchanger to the second outdoor heat exchanger;

a refrigerant line valve for either allowing refrigerant flow through the line or for preventing refrigerant flow through the line;

a bypass line connected to the refrigerant line in parallel with the refrigerant line valve to allow refrigerant to flow through the bypass line when the refrigerant line valve is in a closed position; and restrictor means in the bypass line to effect a pressure drop in refrigerant flowing through the bypass line.

6. The apparatus as set forth in claim 4 wherein the compressor discharges refrigerant to a compressor discharge line and further comprising the compressor discharge line being connected to direct refrigerant to one of the indoor heat exchanger, the first outdoor heat exchanger or the second outdoor heat exchanger, said conduit means further comprising a plurality of valve means being located to allow refrigerant flow from the compressor discharge line to one of the indoor heat exchanger, first outdoor heat exchanger and second outdoor heat exchanger and to prevent refrigerant flow to the remaining two of said heat exchangers.

7. The apparatus as set forth in claim 6 and further comprising a compressor suction line for directing refrigerant to the compressor, said suction line being connected to each of the indoor heat exchanger, the first outdoor heat exchanger and the second outdoor heat exchanger and including valve means for allowing refrigerant to flow from one said heat exchangers to the compressor suction line while preventing flow from the other two of said heat exchangers to the compressor suction line.

8. The apparatus as set forth in claim 1 wherein the first and second outdoor heat exchangers each has more than one circuit and wherein the interconnecting means comprises multiple lines for allowing refrigerant to flow between circuits of said first and second outdoor heat exchangers and further including a valve means associated with each line for selectively preventing flow through said line.

9. The apparatus as set forth in claim 8 and further comprising multiple bypass lines at least one connected to each refrigerant line and including a restriction means such that in the defrost mode of operation the valve means for the refrigerant lines is closed directing all refrigerant flowing between the first and second outdoor heat exchangers through the restrictor means.

10. The method as set forth in claim 2 wherein the step of placing the valve means in a defrost mode further comprises the steps of positioning the valve means in a first defrost mode such that the refrigerant from the compressor is directed first to the first outdoor heat exchanger and in a second defrost mode such that the refrigerant from the compressor is directed first to the second outdoor heat exchanger.

11. The method as set forth in claim 2 wherein the step of placing the valve means for the defrost mode of operation further comprises the refrigerant bypassing the indoor heat exchanger effectively rendering the indoor heat exchanger inoperative for transferring heat energy during the defrost mode.

12. The apparatus as set forth in claim 3 wherein the first and second outdoor heat exchangers are portions of a single master heat exchanger which has been divided to create separate heat exchangers.

13. The apparatus as set forth in claim 3 wherein each heat exchanger has multiple circuits and which further comprises multiple refrigerant lines for connecting the respective circuits of each of the two heat exchangers to each other, each refrigerant line including a refrigerant line valve, multiple bypass lines connecting the circuits of the heat exchangers in parallel with the refrigerant lines and refrigerant line valves and each bypass line being connected to a restrictor means.

* * * * *